US010128041B2

(12) United States Patent
Sakamoto et al.

(10) Patent No.: US 10,128,041 B2
(45) Date of Patent: Nov. 13, 2018

(54) MAGNETIC CORE AND METHOD FOR PRODUCING THE SAME

(71) Applicant: MURATA MANUFACTURING CO., LTD., Kyoto-fu (JP)

(72) Inventors: Sadaaki Sakamoto, Nagaokakyo (JP); Yuya Ishida, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 15/247,145

(22) Filed: Aug. 25, 2016

(65) Prior Publication Data

US 2017/0062117 A1 Mar. 2, 2017

(30) Foreign Application Priority Data

Sep. 1, 2015 (JP) ..... 2015-172154

(51) Int. Cl.

| | |
|---|---|
| ***H01F 1/24*** | (2006.01) |
| ***H01F 41/02*** | (2006.01) |
| ***B22F 1/00*** | (2006.01) |
| ***B22F 1/02*** | (2006.01) |
| *H01F 1/26* | (2006.01) |

(52) U.S. Cl.

CPC ..... *H01F 41/0246* (2013.01); *B22F 1/007* (2013.01); *B22F 1/0062* (2013.01); *B22F 1/02* (2013.01); *H01F 1/24* (2013.01); *C22C 2202/02* (2013.01); *H01F 1/26* (2013.01)

(58) Field of Classification Search

None

See application file for complete search history.

(56) References Cited

U.S. PATENT DOCUMENTS 4,056,411 A * 11/1977 Chen ..... C22C 45/04 148/121
2013/0033354 A1* 2/2013 An ..... H01F 1/33 336/233
2013/0194060 A1* 8/2013 Nakada ..... H01F 27/00 336/192

(Continued)

FOREIGN PATENT DOCUMENTS

CN 101233586 A 7/2008
CN 102956341 A 3/2013

(Continued)

OTHER PUBLICATIONS

Machine Translation of JP 2014-236112 A (Year: 2014).*

(Continued)

*Primary Examiner* — Kevin M Bernatz

(74) *Attorney, Agent, or Firm* — Studebaker & Brackett PC

(57) ABSTRACT

A magnetic core includes soft magnetic material particles each including a soft magnetic material and an insulating film on a surface of the soft magnetic material, the insulating film having a thickness in the range of 10 nm or more and 100 nm or less; and a binder that binds the soft magnetic material particles together and contains a non-silicate glass having a softening point in the range of 350° C. or higher and 500° C. or lower. The soft magnetic material contains an amorphous phase and has a transition temperature of 600° C. or lower at which a crystal structure changes, and the magnetic core has a resistivity of $10^7$ Ωcm or more.

7 Claims, 1 Drawing Sheet

(56) References Cited

U.S. PATENT DOCUMENTS

| | | | | |
|---|---|---|---|---|
| 2014/0368304 | A1* | 12/2014 | Araki | B22F 1/02 335/296 |
| 2015/0159256 | A1* | 6/2015 | Shimizu | C23C 4/06 428/836.1 |
| 2015/0332824 | A1* | 11/2015 | Sakurai | H01F 1/14766 252/62.51 C |
| 2016/0071636 | A1* | 3/2016 | Ohtsubo | H01F 1/20 148/307 |
| 2016/0071637 | A1* | 3/2016 | Inagaki | H01F 27/255 336/234 |
| 2016/0125987 | A1* | 5/2016 | Moon | C22C 45/02 252/62.54 |
| 2017/0032880 | A1* | 2/2017 | Jeong | H01F 1/24 |
| 2017/0076845 | A1* | 3/2017 | Suetsuna | H01F 1/28 |
| 2017/0162307 | A1* | 6/2017 | Ishida | H01F 1/14733 |
| 2017/0263359 | A1* | 9/2017 | Ohtsubo | H01F 3/08 |
| 2017/0294260 | A1* | 10/2017 | Ishida | B22F 1/0062 |

FOREIGN PATENT DOCUMENTS

| | | | |
|---|---|---|---|
| JP | H01-318213 | A | 12/1989 |
| JP | H04-079302 | A | 3/1992 |
| JP | H05-90019 | A | 4/1993 |
| JP | 2005-307291 | A | 11/2005 |
| JP | 2007-092120 | A | 4/2007 |
| JP | 2008-277775 | A | 11/2008 |
| JP | 2010-141183 | A | 6/2010 |
| JP | 2010-206087 | A | 9/2010 |
| JP | 2012-164845 | A | 8/2012 |
| JP | 2012-212853 | A | 11/2012 |
| JP | 2013-033966 | A | 2/2013 |
| JP | 2014-175580 | A | 9/2014 |
| JP | 2014-236112 | A | 12/2014 |
| KR | 10-2013-0023043 | A | 3/2013 |
| TW | 201034775 | A | 10/2010 |
| TW | 201243873 | A | 11/2012 |

OTHER PUBLICATIONS

An Office Action issued by Taiwan Patent Office dated Nov. 30, 2017, which corresponds to Taiwanese Patent Application No. 105128069 and is related to U.S. Appl. No. 15/247,145.

An Office Action; "Notification of Preliminary Rejection," issued by the Korean Intellectual Property Office dated Dec. 11, 2017, which corresponds to Korean Patent Application No. 10-2016-0110685 and is related to U.S. Appl. No. 15/247,145.

Notification of the First Office Action issued by the State Intellectual Property Office of the People's Republic of China dated Feb. 2, 2018, which corresponds to Chinese Patent Application No. 201610772802.3 and is related to U.S. Appl. No. 15/247,145.

An Office Action; "Notification of Reasons for Refusal," dated by the Japanese Patent Office dated May 22, 2018, which corresponds to Japanese Patent Application No. 2015-172154 and is related to U.S. Appl. No. 15/247,145.

* cited by examiner

MAGNETIC CORE AND METHOD FOR PRODUCING THE SAME

CROSS REFERENCE TO RELATED APPLICATIONS

This application claims benefit of priority to Japanese Patent Application 2015-172154 filed Sep. 1, 2015, the entire content of which is incorporated herein by reference.

TECHNICAL FIELD

The present disclosure relates to a magnetic core containing soft magnetic material particles bound together with a binder, and a method for producing the magnetic core.

BACKGROUND

Recent years have seen miniaturization of electric and electronic appliances, and under such trends, magnetic cores used in transformers and coils of electric and electronic appliances have been required to achieve various properties such as high permeability at high frequencies and low eddy-current loss. Magnetic cores used therein are thus required to have high resistance so that the eddy-current loss is low in the high-frequency band. One example of such magnetic cores is a powder core formed by compacting magnetic fine particles each coated with an insulating coating. Compared to when a bulk magnetic material is used, a powder core has low permeability but the resistance can be significantly increased and the eddy-current loss can be significantly decreased.

An example of a method for obtaining a powder core known in the art is a method that includes mixing two or more amorphous soft magnetic alloy powders having different average particle diameters and a low-melting-point glass, coating the resulting mixture with an insulating binder resin, compacting the resulting coated mixture to form a compact, and annealing the compact at a temperature lower than the crystallization temperature (for example, refer to Japanese Unexamined Patent Application Publication No. 2010-141183).

Also known is a method for producing a magnetic layer material by mixing a glass powder with a metal magnetic powder having a core-shell structure (for example, refer to Japanese Unexamined Patent Application Publication No. 2013-33966).

A multilayer coil component that contains a non-silicate glass and a metal magnetic powder is also known (for example, refer to Japanese Unexamined Patent Application Publication No. 2014-236112).

Coil components such as one described above do not have sufficient dielectric strength and their core loss has not been satisfactorily low. Development of coil components with higher dielectric strength and lower core loss has been eagerly anticipated.

SUMMARY

An object of the present disclosure is to provide a magnetic core used in coil components that have higher dielectric strength and lower core loss.

A magnetic core according to an embodiment of the present disclosure includes soft magnetic material particles each including a soft magnetic material and an insulating film on a surface of the soft magnetic material, the insulating film having a thickness in the range of 10 nm or more and 100 nm or less; and a binder that binds the soft magnetic material particles together and contains a non-silicate glass having a softening point in the range of 350° C. or higher and 500° C. or lower. The soft magnetic material contains an amorphous phase and has a transition temperature of 600° C. or lower at which a crystal structure changes, and the magnetic core has a resistivity of $10^7$ Ωcm or more.

According to the magnetic core described above, excellent soft magnetic properties such as high permeability and low coercive force are obtained since the soft magnetic material has an amorphous phase. Of the insulating film and the binder that separate the soft magnetic materials from one another, the insulating film has a thickness in the range of 10 nm or more and 100 nm or less; thus, the soft magnetic materials remain unexposed and the insulating film does not separate from the surface of the soft magnetic material. As a result, a resistivity as high as $10^7$ Ωcm or more can be maintained and low eddy-current loss can be achieved. Since non-silicate glass is contained in the binder, firing can be conducted at a relatively low temperature.

Other features, elements, characteristics and advantages of the present disclosure will become more apparent from the following detailed description of preferred embodiments of the present disclosure with reference to the attached drawings.

DETAILED DESCRIPTION OF THE DRAWINGS

Figure 1:
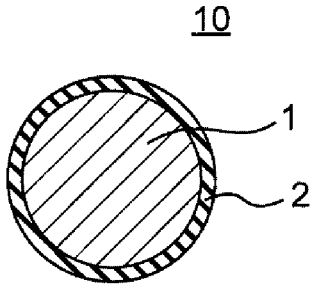
FIG. 1 is an enlarged cross-sectional view showing a microscopic cross-sectional structure of a soft magnetic material particle that constitutes a magnetic core according to a first embodiment.

A magnetic core according to a first embodiment includes soft magnetic material particles each including a soft magnetic material and an insulating film on a surface of the soft magnetic material, the insulating film having a thickness in the range of 10 nm or more and 100 nm or less; and a binder that binds the soft magnetic material particles together and contains a non-silicate glass having a softening point in the range of 350° C. or higher and 500° C. or lower, in which the soft magnetic material contains an amorphous phase and has a transition temperature of 600° C. or lower at which a crystal structure changes, and the magnetic core has a resistivity of $10^7$ Ωcm or more.

According to this structure, excellent soft magnetic properties such as high permeability and low coercive force are obtained since the soft magnetic material has an amorphous phase. Of the insulating film and the binder that separate the soft magnetic materials from one another, the insulating film has a thickness in the range of 10 nm or more and 100 nm or less; thus, the soft magnetic materials remain unexposed and the insulating film does not separate from the surface of the soft magnetic material. As a result, a resistivity as high as $10^7$ Ωcm or more can be maintained and low eddy-current loss can be achieved. Since a non-silicate glass is contained in the binder, firing can be conducted at a relatively low temperature.

According to a magnetic core of a second embodiment, the transition temperature in the first embodiment may be a crystallization temperature.

According to this structure, when firing is conducted at a temperature lower than the temperature at which the amorphous phase crystallizes, magnetostriction attributable to work strain can be eliminated while maintaining the amorphous phase.

According to a magnetic core of a third embodiment, the soft magnetic material of the first embodiment may have a heteroamorphous structure in which nanocrystals are dispersed in an amorphous matrix, and the transition temperature may be a crystallization temperature.

According to this structure, superior soft magnetic properties can be obtained since a soft magnetic material having a heteroamorphous structure is used.

According to a magnetic core of a fourth embodiment, the soft magnetic material in the first embodiment may have a nanocrystal structure that contains a nanosized α-Fe main phase and an intergranular amorphous phase and the transition temperature may be a crystallization temperature.

According to this structure, since a soft magnetic material having a nanocrystal structure is used, superior soft magnetic properties can be obtained.

According to a magnetic core of a fifth embodiment, the non-silicate glass of any one of the first to fourth embodiments may have a total alkali metal content of 0.1% by weight or less.

According to this structure, since the alkali metal content is small, the reaction with the insulating film can be suppressed and degradation of the insulating properties can be suppressed.

According to a magnetic core of a sixth embodiment, the non-silicate glass according to any one of the first and fifth embodiments may be at least one glass selected from the group consisting of a Bi—B—O glass, a V—Ba—Zn—O glass, a P—Sn—O glass, a V—Te—O glass, and a Sn—P—O glass.

According to this structure, the soft magnetic material particles can be bonded to one another by performing firing at a relatively low temperature.

An electronic component of a seventh embodiment may include the magnetic core according to any one of the first to sixth embodiments.

According to this structure, an electronic component that includes the magnetic core can be provided.

A method for producing a magnetic core according to an eighth embodiment includes preparing a dispersion by mixing a soft magnetic material that contains an amorphous phase, a metal alkoxide, a water-soluble polymer, and a solvent; removing the solvent from the dispersion to form a soft magnetic material particle that includes the soft magnetic material and an insulating film disposed on a surface of the soft magnetic material, the insulating film containing the water-soluble polymer; mixing the soft magnetic material particle with a non-silicate glass having a softening point in the range of 350° C. or higher and 500° C. or lower to prepare a mixture; and firing the mixture to obtain a magnetic core.

According to this method, first, an elastic water-soluble polymer is present in the insulating film of the soft magnetic material particle during shaping of the magnetic core. Thus, stress of compaction can be moderated, and shaping can be performed at low pressure. As a result, the insulating film of the soft magnetic material particle does not break, separate, or crack, for example, during compaction performed in the process of producing the magnetic core, and the insulating film and the binder remain undisrupted. As a result, the magnetic core achieves a resistivity as high as $10^7$ Ωcm and low eddy-current loss. Moreover, since an Fe-based soft magnetic material that contains an amorphous phase is used, a magnetic core having excellent soft magnetic properties such as high permeability and low coercive force can be obtained. Since a non-silicate glass is contained in the binder, firing can be performed at a relatively low temperature. Since the alkali metal content is as low as 0.1% by weight or less, the reaction with the insulating film can be suppressed and degradation of the insulating properties can be suppressed.

In a method for producing a magnetic core according to a ninth embodiment, the mixture in the eighth embodiment may be fired at a temperature lower than a transition temperature at which a crystal structure of the soft magnetic material changes.

According to this method, since firing is conducted at a temperature lower than the transition temperature at which the crystal structure changes, magnetostriction attributable to work strain can be eliminated. As a result, core loss can be decreased.

In a method for producing a magnetic core according to a tenth embodiment, the mixture in the eighth embodiment is fired at a temperature lower than a crystallization temperature of the soft magnetic material.

According to this method, since firing is conducted at a temperature lower than the temperature at which the amorphous phase crystallizes, magnetostriction attributable to work strain can be eliminated while maintaining the amorphous phase.

In a method for producing a magnetic core according to an eleventh embodiment, the soft magnetic material in the eighth embodiment may have a heteroamorphous structure in which nanocrystals are dispersed in an amorphous matrix, and the mixture may be fired at a temperature lower than a crystallization temperature of the soft magnetic material.

According to this method, since a soft magnetic material having a heteroamorphous structure is used, superior soft magnetic properties can be obtained.

In a method for producing a magnetic core according to a twelfth embodiment, the soft magnetic material in the eighth embodiment may have a nanocrystal structure containing a nanosized α-Fe main phase and an intergranular amorphous phase, and the mixture may be fired at a temperature lower than a crystallization temperature of the soft magnetic material.

According to this method, since a soft magnetic material having a nanocrystal structure is used, superior soft magnetic properties can be obtained.

In a method for producing a magnetic core according to a thirteenth embodiment, the non-silicate glass of any one of the eighth to twelfth embodiments described above may have a total alkali metal content of 0.1% by weight or less.

According to this method, since the alkali metal content is small, the reaction with the insulating film can be suppressed and degradation of insulating properties can be suppressed.

In a method for producing a magnetic core according to a fourteenth embodiment, the non-silicate glass of any one of the eighth to thirteenth embodiments may be at least one glass selected from the group consisting of a Bi—B—O glass, a V—Ba—Zn—O glass, a P—Sn—O glass, a V—Te—O glass, and a Sn—P—O glass.

According to this method, soft magnetic material particles can be bonded to one another by performing firing at a relatively low temperature.

The embodiments of the magnetic core and the method for producing the magnetic core will now be described with reference to the accompanying drawings. In the drawings, the same or equivalent components are represented by the same reference symbols.

First Embodiment

Magnetic Core

Figure 2:
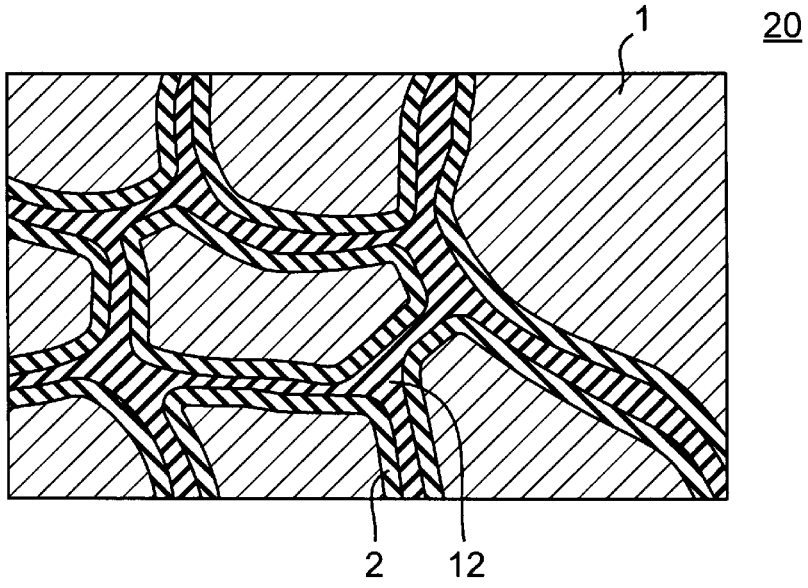
FIG. 2 is an enlarged cross-sectional view showing a microscopic cross-sectional structure of the magnetic core according to the first embodiment.

FIG. 1 is a cross-sectional view showing a cross-sectional structure of a soft magnetic material particle 10 constituting a magnetic core according to a first embodiment. FIG. 2 is an enlarged cross-sectional view of a magnetic core (powder core) 20 according to the first embodiment.

The magnetic core 20 according to the first embodiment includes soft magnetic material particles 10 and a binder 12 containing a non-silicate glass and binding the soft magnetic material particles 10 together. Each of the soft magnetic material particles 10 includes a soft magnetic material 1 and an insulating film 2 covering the surface of the soft magnetic material 1. The thickness of the insulating film 2 is in the range of 10 nm or more and 100 nm or less. The non-silicate glass has a softening point in the range of 350° C. or higher and 500° C. or lower. The magnetic core 20 has a resistivity as high as $10^7$ Ωcm or more. The soft magnetic material includes an amorphous phase and has a transition temperature of 600° C. or higher at which the crystal structure changes.

Since an amorphous phase is contained in the soft magnetic material 1 of this magnetic core 20, excellent soft magnetic properties such as high permeability and low coercive force are achieved.

In the magnetic core 20, the soft magnetic materials 1 are separated from one another by the insulating films 2 and the binder 12. Since the thickness of the insulating film 2 is in the range of 10 nm or more and 100 nm or less, the soft magnetic materials 1 remain unexposed and the insulating films 2 do not separate from the surfaces of the soft magnetic materials 1. Thus, a resistivity as high as $10^7$ Ωcm or more can be maintained due to the presence of the insulating films 2 and the binder 12. As a result, low eddy-current loss is achieved. Since the insulating film 2 covering the soft magnetic material 1 is relatively thin, the thickness of the insulating films 2 is small in the magnetic core 20. Thus, the density of the soft magnetic materials 1 can be increased and a high permeability can be obtained.

Since the magnetic core 20 contains a non-silicate glass serving as a binder, firing can be conducted at a relatively low temperature. Since the alkali metal content of the non-silicate glass is as low as 0.1% by weight or less, the reaction between the non-silicate glass and the insulating film 2 can be suppressed and degradation of insulating properties can be suppressed.

Firing is conducted at a temperature lower than the transition temperature at which the crystal structure changes. Thus, magnetostriction attributable to work strain can be eliminated. In particular, when firing is conducted at a temperature lower than the crystallization temperature, magnetostriction attributable to work strain can be eliminated while maintaining the amorphous phase. As a result, core loss can be decreased. The core loss is preferably 1000 $kW/m^3$ or less. The dielectric strength is preferably $5\times10^4$ V/m or more.

The magnetic core 20 may be used in a coil component or an electronic component such as an inductor. The magnetic core may be a part in the coil component around which a coil conductor is wound. Alternatively, the magnetic core 20 may be a part in the coil component in which a coil conductor is disposed. The coil conductor may be a wire wound into a coil or a patterned conductor having a coil shape.

Components that constitute the magnetic core 20 will now be described.

Soft Magnetic Material

The soft magnetic material 1 is a soft magnetic material that has an ability to be amorphous. Examples of the soft magnetic material include Fe-based metal magnetic materials such as FeSiBCr, FeCoB, FeCoSiB, and FeSiBPCu. The soft magnetic material may also contain impurities.

The soft magnetic material 1 contains an amorphous phase. The soft magnetic material 1 has a transition temperature of 600° C. or lower at which the crystal structure changes. The transition temperature at which the crystal structure changes is, for example, a crystallization temperature. In particular, the soft magnetic material may have a heteroamorphous structure in which nanocrystals are dispersed in an amorphous matrix. The soft magnetic material may have a nanocrystal structure formed of a nanosized α-Fe main phase and an intergranular amorphous phase. This nanocrystal structure is a homogeneous self-assembled structure containing an α-Fe main phase having a grain diameter of 10 nm or more and 20 nm or less and a trace amount of an intergranular amorphous phase. This structure is a result of precipitation of nanocrystals nucleating from α-Fe grains several nanometers in size in the heteroamorphous structure. The self-assembled structure exhibits particularly excellent soft magnetic properties.

For example, FeSiBCr may have a crystallization temperature of 550° C. or 600° C., for example, depending on the composition. FeCoB may have a crystallization temperature of 470° C. FeCoSiB may have a crystallization temperature of 500° C. or 520° C., for example, depending on the composition.

Insulating Film

The insulating film 2 in the magnetic core 20 originates in the insulating film 2 of the soft magnetic material particle 10. In other words, the insulating film 2 contains an inorganic oxide and a water-soluble polymer. However, the insulating film 2 of a magnetic core formed by firing or annealing (hereinafter such a magnetic core may be referred to as an annealed magnetic core) may not always contain a water-soluble polymer. The inorganic oxide contained in the insulating film 2 of the annealed magnetic core may contain an Fe oxide in addition to an oxide of a metal M described above. The inorganic oxide contained in the insulating film 2 of an annealed magnetic core that uses an alloy containing Fe and Cr (for example, FeSiBCr) as the soft magnetic material sometimes contains Cr oxide in addition to the oxide of the metal M and the Fe oxide. The insulating film 2 preferably contains an inorganic oxide that contains more Si than Cr since such an inorganic oxide yields higher dielectric strength.

The thickness of the insulating film is in the range of 10 nm or more and 100 nm or less. At a thickness less than 10 nm, the film is so thin that the soft magnetic material may become exposed. At a thickness exceeding 100 nm, the excessively thick part may separate from the surface of the soft magnetic material. When the insulating film has a thickness in the range of 10 nm or more and 100 nm or less, a resistivity equal to or more than $10^7$ Ωcm and a high insulating property are obtained.

Binder

The binder 12 is an additive used in production of the magnetic core. The binder 12 may be any binder that contains a non-silicate glass. Examples thereof include V—Te—O, Sn—P—O, and Bi—B—O that have a softening point of 350° C. or higher and 500° C. or lower. These may be used alone or in combination of two or more. The binder may further contain a thermosetting resin. Examples of the thermosetting resin include an epoxy resin, an imide resin, a silicone resin, and a fluororesin. These may be used alone or in combination of two or more. The soft magnetic materials 1 are separated from one another by the insulating films 2 and the binder 12.

The non-silicate glass contained in the binder 12 preferably has a total alkali metal content of 0.1% by weight or less. When the alkali metal content exceeds 0.1% by weight, the alkali metal may react with the insulating film 2, possibly resulting in degradation of the insulating properties. When silicate glass is used as a binder as has been a typical practice, large quantities of alkali metals, such as Li, K, and Na, are added to the glass to limit the firing temperature to about 500° C. As a result, the reaction between the $SiO_2$ in the insulating films and the alkali metals contained in the silicate glass in large quantities sometimes degrades the insulating properties. However, the magnetic core according to the first embodiment uses a non-silicate glass so that the firing can be conducted at a low temperature. Thus, the alkali metal content can be decreased and degradation of the insulating properties of the insulating film can be reduced.

By using a non-silicate glass in the binder 12, the magnetic core can be produced by performing firing at a relatively low temperature. Since the alkali metal content is as low as 0.1% by weight or less, degradation of the insulating properties of the insulating film 2 can be reduced.

Method for Producing Magnetic Core

Next, a method for producing the magnetic core 20 is described.

(1) A dispersion is prepared by mixing a soft magnetic material, a metal alkoxide, a water-soluble polymer, and a solvent. For example, a water-soluble polymer is added to a solvent so that the amount of the water-soluble polymer is in the range of 0.01% by weight or more and 1% by weight or less relative to the soft magnetic material. For example, when silicon alkoxide is used as the metal alkoxide, silicon alkoxide is added to the solvent so that the amount of the silicon alkoxide in terms of $SiO_2$ is 0.01% by weight or more and 5% by weight or less relative to the soft magnetic material.

(2) The solvent is removed from the dispersion so as to form a soft magnetic material particle 10 that includes a soft magnetic material 1 and an insulating film 2 disposed on the surface of the soft magnetic material 1 and containing the water-soluble polymer. The solvent may be removed by, for example, drying. During removal of the solvent, the metal alkoxide is hydrolyzed, and as a result, an insulating film 2 that contains a metal oxide, which is a hydrolysate of the metal alkoxide, and the water-soluble polymer is formed on the soft magnetic material 1.

(3) The soft magnetic material particles 10 and a non-silicate glass having a softening point in the range of 350° C. or higher and 500° C. or lower are mixed to prepare a mixture. The non-silicate glass serves as the binder 12 that binds the soft magnetic materials 1 together. The non-silicate glass may be any non-silicate glass having a softening point in the range of 350° C. or higher and 500° C. or lower. Examples of the non-silicate glass include V—Te—O, Sn—P—O, and Bi—B—O. These may be used alone or in combination of two or more. The binder 12 content may be in the range of 1% by weight or more and 6% by weight or less relative to 100% by weight of the magnetic core.

Glass frit or a silane coupling agent may be used to increase the strength of the magnetic core. Compaction may be performed, and a mold may be used for the compaction. Compaction increases the density of the soft magnetic materials 1. Compaction is optional and may be conducted as needed. The magnetic core obtained through compaction is called a powder core. A magnetic core that has not undergone compaction is referred to simply as a magnetic core. For the purposes of this specification, a "magnetic core" refers to a wide variety of magnetic cores irrespective of whether they have undergone compaction.

(4) The mixture is fired to obtain a magnetic core 20. The firing temperature may be, for example, any temperature lower than the transition temperature of the soft magnetic material 1 at which the crystal structure changes. Specifically, when the soft magnetic material 1 contains an amorphous phase, the firing temperature of the mixture may be any temperature lower than the crystallization temperature of the soft magnetic material 1. When the soft magnetic material 1 has a heteroamorphous structure in which nanocrystals are dispersed in an amorphous matrix, the firing temperature may be any temperature lower than the crystallization temperature of the soft magnetic material 1. When the soft magnetic material 1 has a nanocrystal structure containing a nanosized α-Fe main phase and an intergranular amorphous phase, the firing temperature of the mixture is lower than the transition temperature so that the magnetostriction attributable to the work strain can be eliminated while the amorphous phase is maintained. As a result, the core loss can be decreased. The firing temperature in this case is lower than the transition temperature. The firing temperature is preferably a temperature as close to the transition temperature as possible, for example, in the range of 50° C. to 10° C. lower than the transition temperature. As a result, magnetostriction can be more effectively eliminated and the core loss can be further decreased.

An annealing process may be conducted afterward. Since the core loss is dependent on the frequency, the annealing process may be omitted depending on the frequency band of the magnetic core concerned. If needed, the magnetic core is annealed at a temperature of 400° C. or higher. The annealing process may be conducted in the temperature range of 400° C. or higher and 900° C. or lower or in the range of 600° C. or higher and 900° C. or lower, in air or a $N_2$ or $N_2$+$H_2$ atmosphere.

A magnetic core can be obtained through these steps. A magnetic core that has undergone the annealing process at 400° C. or higher is called an annealed magnetic core, for example. A magnetic core that has not been subjected to the annealing process is called a thermally consolidated magnetic core, for example.

According to the method for producing a magnetic core, first, soft magnetic material particles 10 that each include an Fe-based soft magnetic material 1 containing an amorphous phase and an insulating film 2 containing a water-soluble polymer and covering the soft magnetic material 1 can be obtained. The soft magnetic material particles 10 are mixed with a non-silicate glass to form a mixture, and the mixture is fired to obtain a magnetic core. When the magnetic core is being shaped, the water-soluble polymer, which is elastic, is present in the insulating film 2 of the soft magnetic material particle 10 and thus stress of compaction can be moderated and shaping can be performed at a low pressure. As a result, the insulating film 2 of the soft magnetic material particle 10 does not break, separate, or crack, for example, during compaction performed in the process of producing the magnetic core 20, and the insulating film 2 and the binder 12 remain undisrupted. As a result, the magnetic core achieves a resistivity as high as $10^7$ Ωcm and low eddy-current loss.

Since the soft magnetic material 1 is an Fe-based soft magnetic material that contains an amorphous phase, a magnetic core having excellent soft magnetic properties, namely, high permeability and low coercive force, can be obtained.

Since a non-silicate glass is contained as the binder, firing can be conducted at a relatively low temperature. Since the alkali metal content in the non-silicate glass is as low as 0.1% by weight or less, the reaction between the non-silicate glass and the insulating film 2 can be suppressed, and degradation of the insulating properties can be reduced.

Since firing is conducted at a temperature lower than the transition temperature at which the crystal structure changes, magnetostriction attributable to the work strain can be eliminated while maintaining the amorphous phase. As a result, the core loss can be decreased.

Materials used in the method for producing a magnetic core will now be described.

Soft Magnetic Material

The soft magnetic material 1 is the same as one described above. The descriptions therefor are thus omitted.

Insulating Film

The insulating film 2 contains an inorganic oxide and a water-soluble polymer.

Inorganic Oxide

The metal M constituting the inorganic oxide is at least one metal selected from the group consisting of Li, Na, Mg, Al, Si, K, Ca, Ti, Cu, Sr, Y, Zr, Ba, Ce, Ta, and Bi. Considering the strength and inherent resistivity of the oxide obtained, the metal M is preferably at least one metal selected from the group consisting of Si, Ti, Al, and Zr. The metal M is the metal of a metal alkoxide used in forming the insulating film 2. Specific examples of the inorganic oxide include $SiO_2$, $TiO_2$, $Al_3$, and ZrO. $SiO_2$ is particularly preferable.

The inorganic oxide content relative to the soft magnetic material 1 is in the range of 0.01% by weight or more and 5% by weight or less.

Water-Soluble Polymer

The water-soluble polymer is one material or a combination of at least two materials selected from the group consisting of polyethylenimine, polyvinyl pyrrolidone, polyethylene glycol, sodium polyacrylate, carboxymethyl cellulose, polyvinyl alcohol, and gelatin.

The water-soluble polymer content relative to the soft magnetic material 1 is in the range of 0.01% by weight or more and 1% by weight or less.

Solvent

Water may be used as the solvent. Alternatively, an alcohol such as methanol or ethanol may be used as the solvent.

Metal Alkoxide

The metal M of the metal alkoxide M-OR to be added may be at least one metal selected from the group consisting of Li, Na, Mg, Al, Si, K, Ca, Ti, Cu, Sr, Y, Zr, Ba, Ce, Ta, and Bi. Considering the strength and inherent resistivity of the oxide obtained, Si, Ti, Al, and Zr are preferable.

The alkoxy group OR of the metal alkoxide may be a methoxy group, an ethoxy group, a propoxy group, and any other suitable alkoxy group.

Two or more metal alkoxides may be used in combination.

In order to accelerate hydrolysis of the metal alkoxide, a catalyst may be added as needed. Examples of the catalyst include acidic catalysts such as hydrochloric acid, acetic acid, and phosphoric acid, basic catalysts such as ammonia, sodium hydroxide, and piperidine, and salt catalysts such as ammonium carbonate and ammonium acetate.

The dispersion after stirring may be dried by a suitable method (by using an oven, spraying, or vacuum drying). The drying temperature may be in the temperature range of 50° C. or higher and 300° C. or lower, for example. The drying time may be set as needed. For example, the drying time may be in the range of 10 minutes or longer and 24 hours or shorter.

Non-Silicate Glass

The non-silicate glass is the same as that described above and the description is not repeated.

EXAMPLES

The method for producing a magnetic core and a magnetic core obtained through the method will now be described by using Examples.

The method for producing a magnetic core is described by dividing the method into a process of insulating the soft magnetic material and a process of preparing a magnetic core.

Process of Insulating Soft Magnetic Material (1) To 37.2 g of ethanol, 20 g of a soft magnetic material, namely, FeSiBCr powder having an average particle diameter of 30 μm, was added.

(2) Next, 1% by weight of tetraethyl orthosilicate in terms of $SiO_2$ relative to the amount of the soft magnetic material was weighed and added to the mixture of ethanol and the FeSiBCr powder. The resulting mixture was stirred at room temperature for 60 minutes.

(3) Next, 0.1% by weight of a water-soluble polymer, polyvinyl pyrrolidone, was weighed relative to 100% by weight of the soft magnetic material, and dissolved in 3.2 g of pure water. The resulting solution was added to the mixture of ethanol, the FeSiBCr powder, and tetraethyl orthosilicate dropwise. The resulting mixture was stirred for 60 minutes.

As a result, insulated soft magnetic material particles 10 were obtained.

Preparation of Magnetic Core (a) The insulated soft magnetic material particles (95 g) obtained as described above, 5 g of glass having an average particle diameter of 1 μm and serving as a binder, and 5 g of an acrylic resin were mixed. The resulting mixture was formed into two types of samples at a pressure of 4 t/cm$^2$: cylindrical samples having a diameter of 10 mm and a thickness of 1 mm and ring samples having an inner diameter of 4 mm, an outer diameter of 9 mm, and a thickness of 1 mm.

At least one non-silicate glass selected from V—Te—O, Sn—P—O, and Bi—B—O and having a softening point of 350° C. to 500° C. was used as the glass. The softening point of the glass was confirmed through endothermic peaks under thermogravimetry-differential thermal analysis (TG-DTA).

(b) Next, the cylindrical samples and the ring samples were heat-treated in air at 300° C. to remove the resin component, and fired at 500° C. in nitrogen.

As a result, a magnetic core (powder core) was obtained.

Evaluation of Properties

Evaluation of properties of the magnetic core obtained is described next.

Measurement of Core Loss

The ring sample was analyzed with a B-H analyzer (Iwatsu SY-8218) to determine magnetic properties and measure the core loss at 1 MHz.

Measurement of Electrical Properties

Electrodes were attached to top and bottom faces of the cylindrical sample, and a voltage was applied between the electrodes to measure the resistance by using a high-resistance meter (ADVANTEST R830A ULTRA HIGH RESISTANCE METER) and determine the resistivity and dielectric strength.

Determination of Structure, Composition, and Thickness of Insulating Film

A thin section was taken from the ring sample and the insulating film in the thin section was observed with a transmission electron microscope to determine the thickness of the insulating film. The composition of the insulating film was determined by energy-dispersive X-ray spectroscopy (EDX). The soft magnetic material particles were subjected to electron beam diffraction and were confirmed to be amorphous. The glass portion was subjected to EDX to confirm absence of changes in composition.

A thin section taken from the ring sample was observed with a transmission electron microscope at magnification of 100,000 to 200,000 by taking images of five observation areas. The thickness of the insulating film was measured at five positions in each image, and the average thickness of the insulating film was determined. The composition of the insulating film was analyzed by EDX.

Table 1 shows the production conditions and the measurement results of Examples in which the thickness of the insulating film was varied (Examples 1 to 4) and Comparative Examples in which the thickness of the insulating film was outside the range (Comparative Examples 1 and 2).

Table 2 shows the production conditions and the measurement results of Examples in which a non-silicate glass having different compositions were used (Examples 5 and 6) and Comparative Examples in which silicate glass was used (Comparative Examples 3 and 4).

Table 3 shows the production conditions and the measurement results of Example in which a soft magnetic material having a different transition temperature was used (Example 7) and Comparative Example in which a crystalline soft magnetic material is used (Comparative Example 5).

Table 4 shows the production conditions and the measurement results of Comparative Example in which a water-soluble polymer, polyvinyl pyrrolidone, was not added during formation of the insulating film (Comparative Example 6) and Examples in which a non-silicate glass having different softening points were used (Examples 8 and 9).

TABLE 1

| | Soft magnetic material | | Insulating film | | Glass | | | | |
|---|---|---|---|---|---|---|---|---|---|
| No. | Composition | Transition temperature ° C. | Composition | Thickness nm | Composition | Softening point ° C. | Resistivity $\times 10^7$ Ωcm | Core loss $kWm^{-3}$ | Dielectric strength $\times 10^5/Vm^{-1}$ |
| Example 1 | FeSiBCr | 550 | Si | 10 | V—Te—O | 350 | 10 | 800 | 1 |
| Example 2 | FeSiBCr | 550 | Si | 20 | V—Te—O | 350 | 200 | 700 | 2 |
| Example 3 | FeSiBCr | 550 | Si | 50 | V—Te—O | 350 | 200 | 700 | 5 |
| Example 4 | FeSiBCr | 550 | Si | 100 | V—Te—O | 350 | 200 | 700 | 2 |
| Comparative Example 1 | FeSiBCr | 550 | Si | 150 | V—Te—O | 350 | 10 | 1500 | 0.2 |
| Comparative Example 2 | FeSiBCr | 550 | Si | 5 | V—Te—O | 350 | 0.5 | 2000 | 0.8 |

TABLE 2

| | Soft magnetic material | | Insulating film | | Glass | | | | |
|---|---|---|---|---|---|---|---|---|---|
| No. | Composition | Transition temperature ° C. | Composition | Thickness nm | Composition | Softening point ° C. | Resistivity $\times 10^7$ Ωcm | Core loss $kWm^{-3}$ | Dielectric strength $\times 10^5/Vm^{-1}$ |
| Comparative Example 3 | FeSiBCr | 550 | Si | 50 | Si—Li—B—O | 300 | 0.01 | 9500 | 0.03 |
| Example 5 | FeSiBCr | 550 | Si | 50 | Sn—P—O | 450 | 200 | 700 | 3 |
| Example 6 | FeSiBCr | 550 | Si | 50 | Bi—B—O | 500 | 200 | 700 | 2 |
| Comparative Example 4 | FeSiBCr | 550 | Si | 50 | Si—K—B—O | 550 | 0.03 | 7800 | 0.02 |

TABLE 3

| | Soft magnetic material | | | | Glass | | | | |
|---|---|---|---|---|---|---|---|---|---|
| | | Transition | Insulating film | | | Softening | | Core | Dielectric |
| No. | Composition | temperature ° C. | Composition | Thickness nm | Composition | point ° C. | Resistivity $\times 10^7$ Ωcm | loss $kWm^{-3}$ | strength $\times 10^5/Vm^{-1}$ |
| Example 7 | FeSiBCr | 600 | Si | 50 | V—Te—O | 350 | 200 | 300 | 4 |
| Comparative Example 5 | FeSiCr | — | Si | 50 | V—Te—O | 350 | 200 | 2500 | 3 |

TABLE 4

| | Soft magnetic material | | | | Glass | | | | |
|---|---|---|---|---|---|---|---|---|---|
| | | Transition | Insulating film | | | Softening | | Core | Dielectric |
| No. | Composition | temperature ° C. | Composition | Thickness nm | Composition | point ° C. | Resistivity $\times 10^7$ Ωcm | loss $kWm^{-3}$ | strength $\times 10^5/Vm^{-1}$ |
| Comparative Example 6 | FeSiBCr | 550 | Si | 50 | V—Te—O | 400 | 0.2 | 3000 | 0.1 |
| Example 8 | FeSiBCr | 550 | Si | 50 | V—Te—O | 400 | 1 | 800 | 2 |
| Example 9 | FeSiBCr | 550 | Si | 50 | V—Te—O | 400 | 100 | 500 | 3 |

In this disclosure, the embodiments described above may be used in combination and such a combination can exhibit advantageous effects of the respective embodiments.

A magnetic core according to the present disclosure includes soft magnetic materials that have an amorphous phase, and thus has excellent soft magnetic properties such as high permeability and low coercive force. Of the insulating film and the binder that separate the soft magnetic materials from one another, the insulating film has a thickness in the range of 10 nm or more and 100 nm or less. Thus, the soft magnetic materials do not become exposed and the insulating film does not separate from the surface of the soft magnetic material. A high resistivity of $10^7$ Ωcm or more can be maintained accordingly. As a result, the eddy-current loss is decreased. Since a non-silicate glass is contained as the binder, firing can be performed at a relatively low temperature.

While preferred embodiments of the disclosure have been described above, it is to be understood that variations and modifications will be apparent to those skilled in the art without departing from the scope and spirit of the invention. The scope of the invention, therefore, is to be determined solely by the following claims.

What is claimed is:

1. A magnetic core comprising:

soft magnetic material particles each including:

a soft magnetic material, and an insulating film on a surface of the soft magnetic material, the insulating film having a thickness in the range of 10 nm or more and 100 nm or less; and a binder that binds the soft magnetic material particles together and contains a non-silicate glass having a softening point in the range of 350° C. or higher and 500° C. or lower, wherein the soft magnetic material contains an amorphous phase and has a transition temperature of 600° C. or lower at which a crystal structure changes, the magnetic core has a resistivity of $10^7$ Ωcm or more, and the non-silicate glass is a V—Te—O glass.

2. The magnetic core according to claim 1, wherein the transition temperature is a crystallization temperature.

3. The magnetic core according to claim 1, wherein the soft magnetic material has a heteroamorphous structure in which nanocrystals are dispersed in an amorphous matrix, and the transition temperature is a crystallization temperature.

4. The magnetic core according to claim 1, wherein the soft magnetic material has a nanocrystal structure that contains a nanosized α-Fe main phase and an intergranular amorphous phase, and the transition temperature is a crystallization temperature.

5. The magnetic core according to claim 1, wherein the non-silicate glass has a total alkali metal content of 0.1% by weight or less.

6. An electronic component comprising the magnetic core according to claim 1.

7. The magnetic core according to claim 1, wherein the insulating film is made of metal alkoxide.

* * * * *